US006944883B1

(12) United States Patent
Cuaz

(10) Patent No.: US 6,944,883 B1
(45) Date of Patent: Sep. 20, 2005

(54) JUMPSUIT FOR A WOMAN AND METHOD OF USE

(76) Inventor: Laura Durfey Cuaz, P.O. Box 2032, Running Springs, CA (US) 92382

( * ) Notice: Subject to any disclaimer, the term of this patent is extended or adjusted under 35 U.S.C. 154(b) by 0 days.

(21) Appl. No.: 10/864,734

(22) Filed: Jun. 10, 2004

(51) Int. Cl.[7] ..... A41D 13/00
(52) U.S. Cl. ..... 2/69; 2/79
(58) Field of Search ..... 2/79, 69, 69.5, 2/78.1–78.4, 73, 80, 81, 82, 83, 114

(56) References Cited

U.S. PATENT DOCUMENTS 1,398,443 A * 11/1921 Pendergrass ..... 2/79
1,479,854 A * 1/1924 Heller ..... 2/79
2,405,421 A * 8/1946 Guyon ..... 29/505
2,471,086 A * 5/1949 Ackerman ..... 2/80
2,849,717 A * 9/1958 Sol ..... 2/79
3,041,625 A * 7/1962 Joseph ..... 2/80
3,711,865 A * 1/1973 Schifman ..... 2/79
3,949,427 A * 4/1976 Sampey ..... 2/79
4,447,911 A * 5/1984 Marcellaro ..... 2/79
4,535,480 A * 8/1985 Kunieda ..... 2/79
6,789,269 B1 * 9/2004 Scovin ..... 2/227

* cited by examiner

*Primary Examiner*—Gloria M. Hale
(74) *Attorney, Agent, or Firm*—Timothy Thut Tyson; Ted Masters; Freilich, Hornbaker & Rosen

(57) ABSTRACT

A jumpsuit is provided for meeting the needs of a woman. The jumpsuit has a cicumferential fastener which when closed fully connects upper and lower portions of the suit. When the fastener is fully opened, the lower portion is partially separated from the upper portion. When the woman then squats, the lower portion may be pulled down the thighs away from the crotch.

2 Claims, 8 Drawing Sheets

JUMPSUIT FOR A WOMAN AND METHOD OF USE

TECHNICAL FIELD

The present invention pertains generally to one piece garments of the jumpsuit variety such as, coveralls, body suits, flight suits, and overalls, and more particularly to a jumpsuit which facilitates the urination process for a women.

BACKGROUND OF THE INVENTION

Jumpsuits having selectively opening flaps are well known in the art. For example, U.S. Pat. No. 2,263,146 illustrates a coverall garment which has a zippered flap. The flap has a horizontal top and opposite downwardly extending sides.

U.S. Pat. No. 2,849,717 discloses a zipper drop seat garment in which the slide fastener is wholly concealed under a belt and in the pockets of the garment.

U.S. Pat. No. 4,447,991 shows a jumpsuit having hidden access flaps in the seat portion which can be easily opened and closed to allow the wearer to use toilet facilities without completely removing the garment. The access flaps are formed from a horizontal separation across the garment back at the waist and an invisible zipper which starts at the crotch rear area and extends vertically to and intersects the waistline area at the separation. A piece of elasticized material is attached to the garment above the separation and extends downward and covers the separation when the zipper is closed. A plurality of snaps or hook fasteners are spaced apart along the edges of the waist separation to secure the flaps to the upper waist portion of the garment. In another embodiment, the elasticized material is integral with the garment giving a more finished appearance.

U.S. Pat. No. 4,535,480 consists of a one piece garment in which the back is separated into two parts, upper and lower, by a horizontal opening formed in the small of the back and which is connected at both extremities to vertical slits formed along both sides of the garment. The upper half of the back has fastener members on its lower corners with which it can be secured to the front. The lower half has an elastic belt at its upper edge and fasteners along the slits, which together make the garment fit the wearer well at work or during exercise.

U.S. Pat. No. 4,607,396 describes a coverall type garment comprised of integrally formed upper blouse or shirt portion and a lower pants portion. The pants portion has an integrally formed panel to permit a person wearing the garment to comfortably use restroom facilities. The panel is uniquely formed to be completely concealed and also as a fashion feature when the garment is being worn. The concealment is accomplished by forming the panel as a part of the waistband and belt and side pockets. The rear seam of the opening of the opening entrance to the side pockets forms a seam for the panel so that seams for the panel are completely concealed. The flaps of the material forming the pocket are constructed to unfold when the panel is released providing a wide opening.

U.S. Pat. No. 5,014,356 shows a jumpsuit with an improved, utilitarian drop seat having a bodice attached to pants at the front waist seam. The pants have hidden, inseam side pockets that facilitate the opening of the drop seat area. The drop seat area has a back, elasticized waistband and side tabs having fasteners that, when fastened, secure the drop seat in closed position with the appearance of a normal jumpsuit.

Although jumpsuits designs have sought ways to ease the processes of relieving bodily needs, none are specifically tailored to accommodate the anatomical differences of women. Drop seat covers for buttocks, whether "C" or "U" shaped, do not allow the garment to be removed from the area directly below the crotch, and as such are not sufficient for a woman to urinate, whether at a toilet or in a portable urinal. Back drop designs are therefore not the answer to a woman's sometimes frequent urination needs. The back drop seats are simply made to ease the process of defecation. There is no known prior art which meets a woman's requirements for urination while wearing a jumpsuit.

When a man needs to urinate while wearing any of the currently available flight configuration suits or body suits used by the majority of government fliers, he merely has to raise the zipper from the crotch upward. It is a two way zipper so there is no need for him to release the zipper all the way down from the top. A women, on the other hand, must remove the jumpsuit over her hips.

BRIEF SUMMARY OF THE INVENTION

The present invention is directed to a jumpsuit specifically tailored to the anatomical needs of a woman. An elongated circumferential zipper provides a way for a woman to undo the jumpsuit and urinate without having to take off the jumpsuit. The zipper is located below the waistline and above the hips, and extends at least 270° around the jumpsuit. Because of the zipper, the jumpsuit may be completely removed from the area below the crotch without disrobing by squatting and moving the lower portion toward the knees. The jumpsuit is particularly useful for flying where urination can be a problem on long flights.

In accordance with a preferred embodiment of the invention, a jumpsuit for a woman, includes a body having a central axis, a waist, a front side, an upper portion, and a lower portion. A fastener means is provided for selectively connecting the upper portion to the lower portion. The fastener means has a first end and an opposite second end. When the fastener means is fully closed, the upper portion is connected to the lower portion. When the fastener means is fully open, the upper portion is partially connected to the lower portion by a thin connector strip which is disposed between the first end and the second end of the fastener means. The connector strip is substantially centrally disposed on the front side of the jumpsuit. The fastener means circumscribes an arc of at least 270° around the central axis of the jumpsuit.

In accordance with an aspect of the invention, the arc is about 340°.

In accordance with another aspect of the invention, the arc disposed is substantially perpendicular to the central axis so the fastener means is substantially horizontal.

In accordance with another aspect of the invention, the first and second ends of the fastener means are disposed below the waist of the jumpsuit.

In accordance with another aspect of the invention, when the fastener means is fully open the lower portion splits away from the upper portion so the woman may assume a squatting position wherein the lower portion may be pulled down the thighs thereby vacating the lower portion from an area below the woman's crotch.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
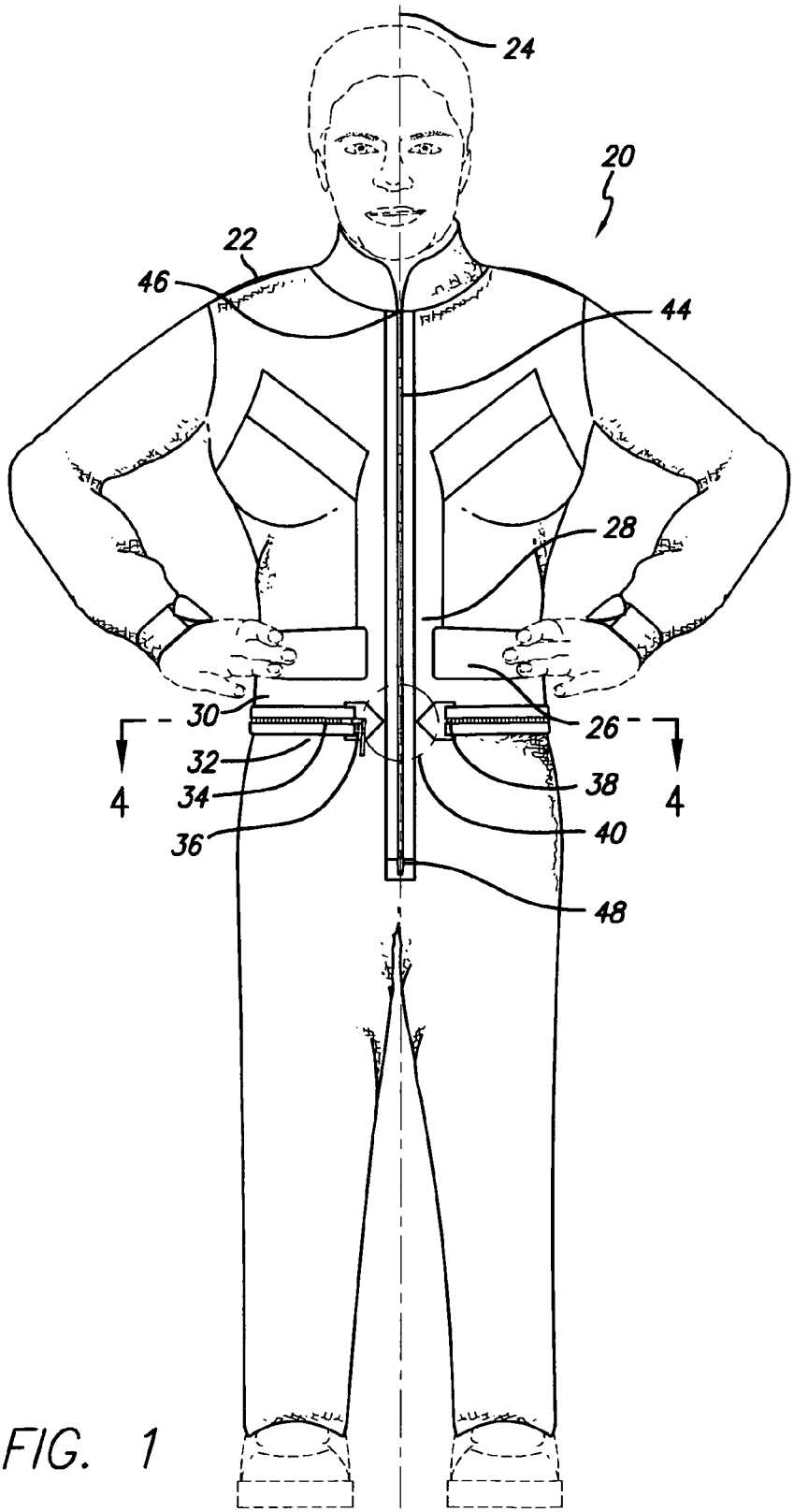
FIG. 1 is a front elevation view of a jumpsuit in accordance with the present invention.
Figure 2:
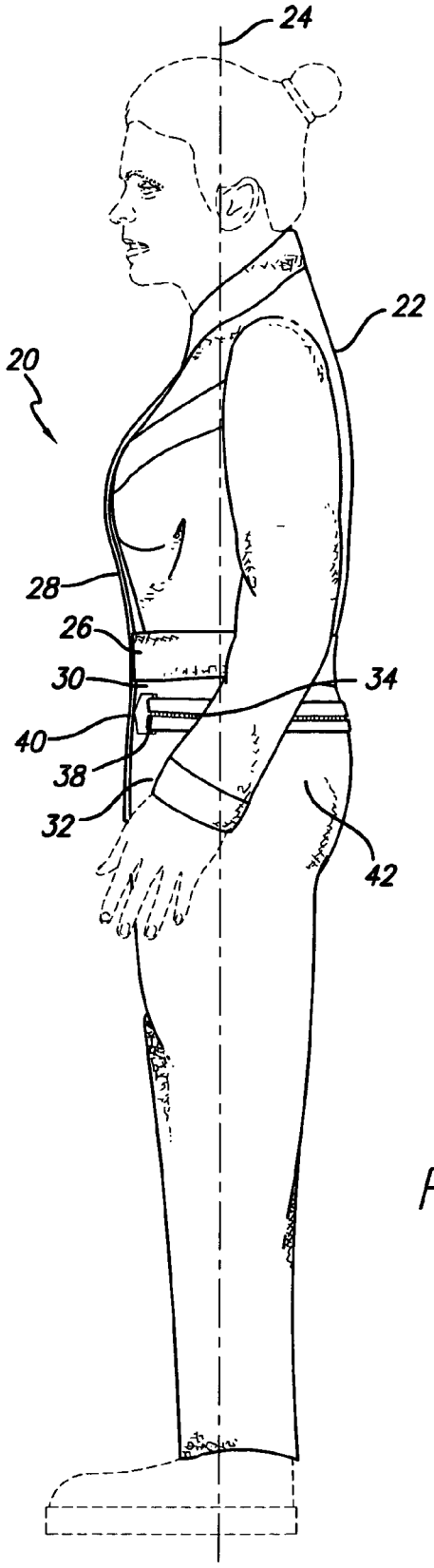
FIG. 2 is a side elevation view of the jumpsuit.
Figure 3:
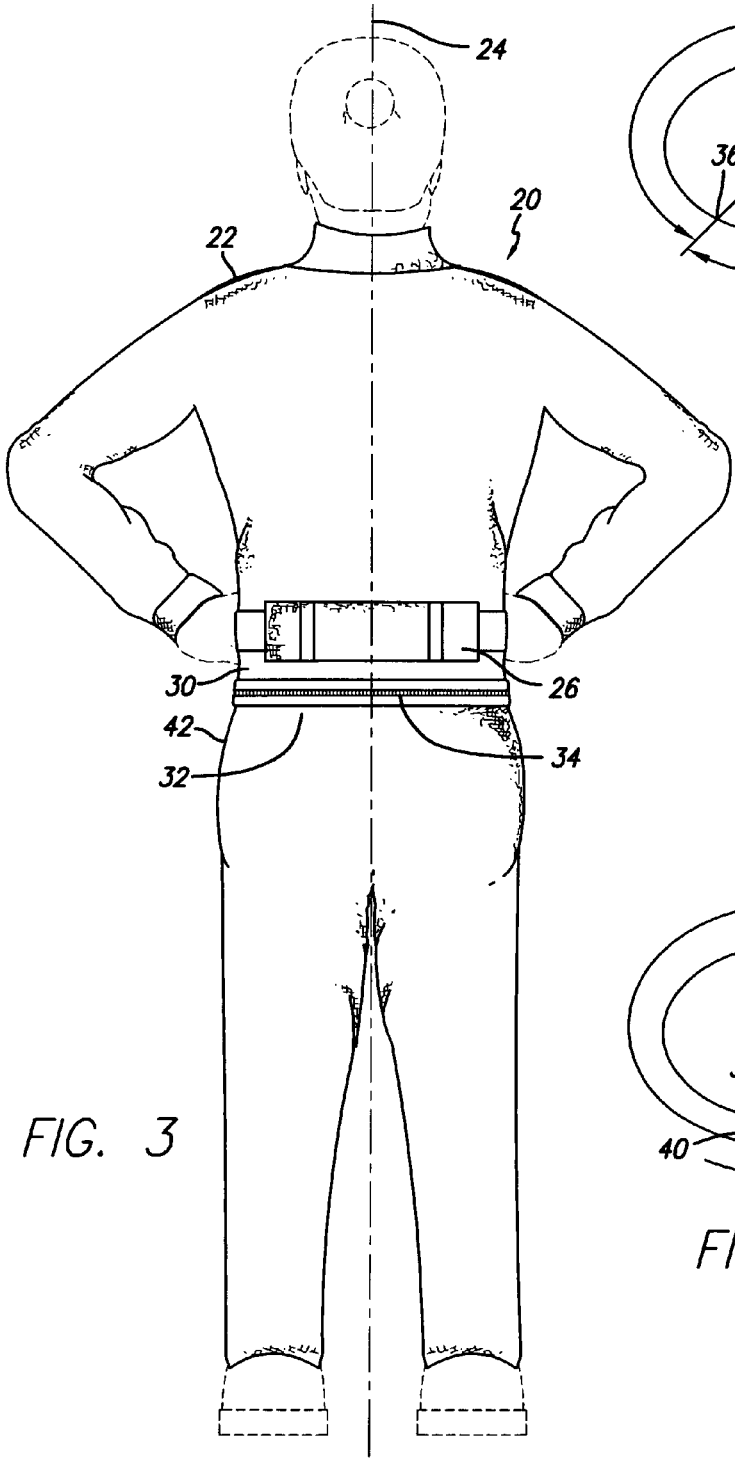
FIG. 3 is a rear elevation view of the jumpsuit.

FIGS. 1–3 show front elevation, side elevation, and rear elevation views, respectively, of a jumpsuit in accordance with the present invention, generally designated 20. As used herein, the term "jumpsuit" embraces all garments of the one piece variety such as coveralls, body suits, flight suits, and overalls. Jumpsuit 20 is fitted to the body of the wearer and is typically neither loosely nor tightly fitting. Jumpsuit 20 includes a body 22 having a central axis 24, a waist 26, a front side 28, an upper portion 30, and a lower portion 32. Jumpsuit 20 also includes fastener means 34 for selectively connecting upper portion 30 to lower portion 32. Fastener means 34 has a first end 36 and an opposite second end 38. When fastener means 34 is fully closed as is shown in FIGS. 1–3, upper portion 30 is connected to lower portion 32. As used herein, the term "connected" means that the bottom perimeter of upper portion 30 is connected to the top perimeter of lower portion 32. In a preferred embodiment, the connection is a continuous connection such as would be effected by the shown zipper fastener means 34. Hook and loop bands, and slide fasteners would also provide a continuous connection. In another embodiment, the fastener means 34 could be cooperating buttons, snaps, or hooks which are spaced around the bottom perimeter of the upper portion 30 and the top perimeter of the lower portion 32.

When fastener means 34 is fully open (refer to FIGS. 8–10), upper portion 30 is partially connected to lower portion 32 by a connector strip 40 (dashed area in FIG. 1) which is disposed between first end 36 and second end 38 of fastener means 34. Connector strip 40 is substantially centrally disposed on front side 28. Also referring to FIG. 4, fastener means 34 circumscribes an arc of at least 270° around central axis 24. In a preferred embodiment, the arc is about 340° (refer to FIG. 5). That is, connector strip 40 is only about 20° wide. In the shown embodiment, the arc is disposed substantially perpendicular to central axis 24. In other words, fastener means 34 resides in substantially horizontal orientation when jumpsuit 20 is worn by a standing person. It is also noted that first end 36 and second end 38 of fastener means 34 are disposed below the waist 26 and above the hips 42 of the wearer.

Jumpsuit 20 further includes a second fastener means 44 having an upper end 46 and a lower end 48. Second fastener means 44 is disposed on front side 28 oriented parallel to central axis 24. It substantially bisects connector strip 40. Second fastener means 44 runs from below fastener means 34 to above waist 26, and opens upward from lower end 48.

Figure 4:
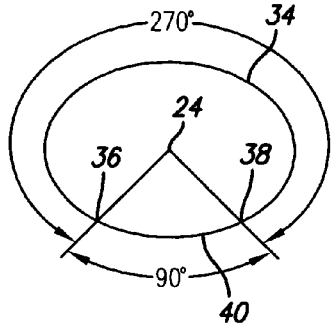
FIG. 4 is a view along the line 4—4 of FIG. 1.

FIG. 4 is a view along the line 4—4 of FIG. 1. Fastener means 34 circumscribes an arc of at least 270° around central axis 24. This allows lower portion 32 to separate from upper portion 34 so the lower portion may be moved up the wearer's thighs 500 to the hollow of the knees 502 which is the inside portion of the knee opposite the knee cap (refer to FIGS. 8–10).

Figure 5:
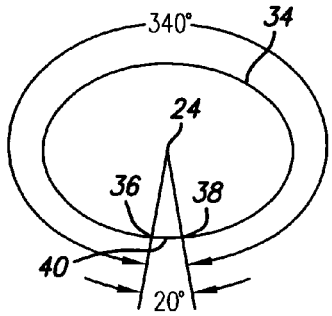
FIG. 5 is an alternate view along the line 4—4 of FIG. 1.

FIG. 5 is an alternate view along the line 4—4 of FIG. 1. In this view, fastener means 34 circumscribes an arc which is about 340° thereby almost separating upper portion 30 from lower portion 32. That is, connector strip 40 is only about 20° wide, thereby making the separation of lower portion 32 from upper portion 30 even easier.

Figure 6:
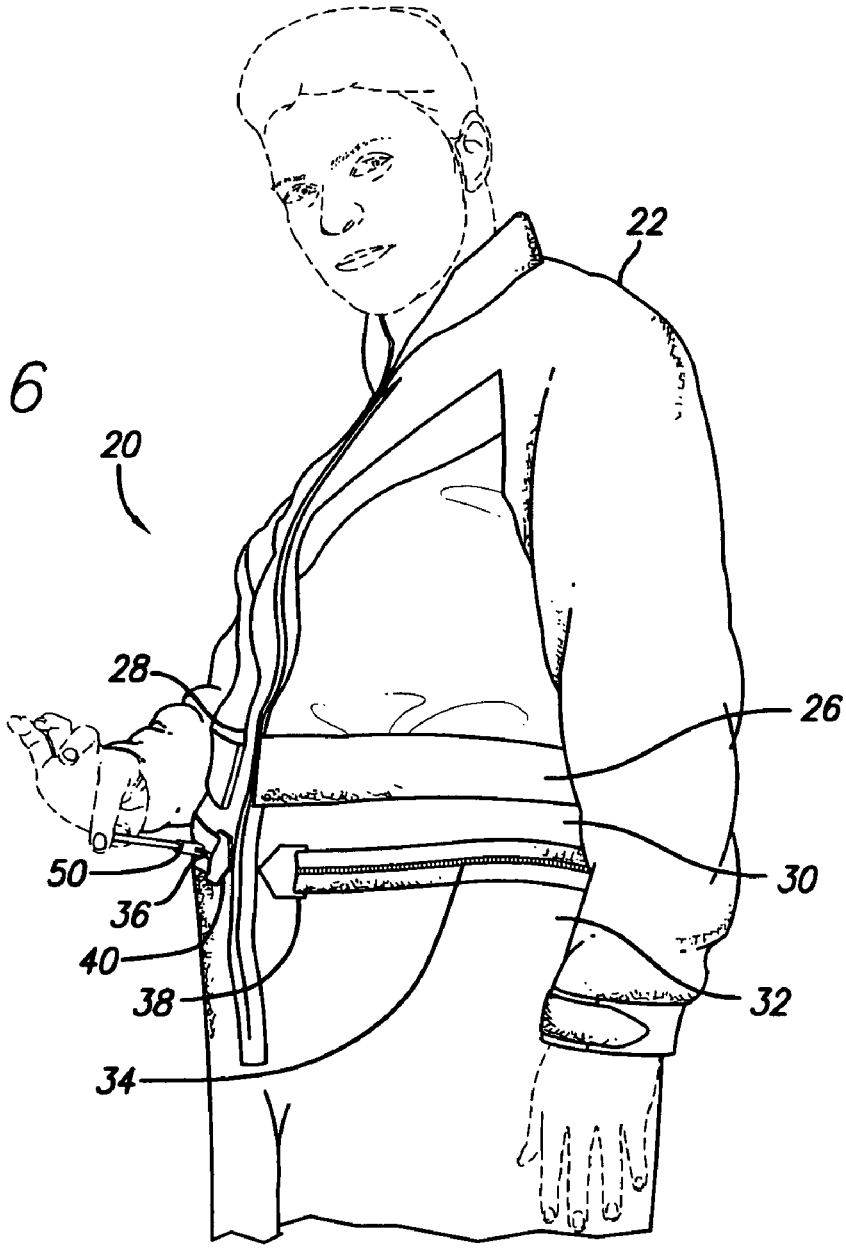
FIG. 6 is a side elevation view of a fastener means starting to be opened from a fully closed position.

FIG. 6 is a side elevation view of fastener means 34 starting to be opened by the wearer from a fully closed position. In the shown embodiment, the wearer uses a zipper tab 50 to effect the opening.

Figure 7:
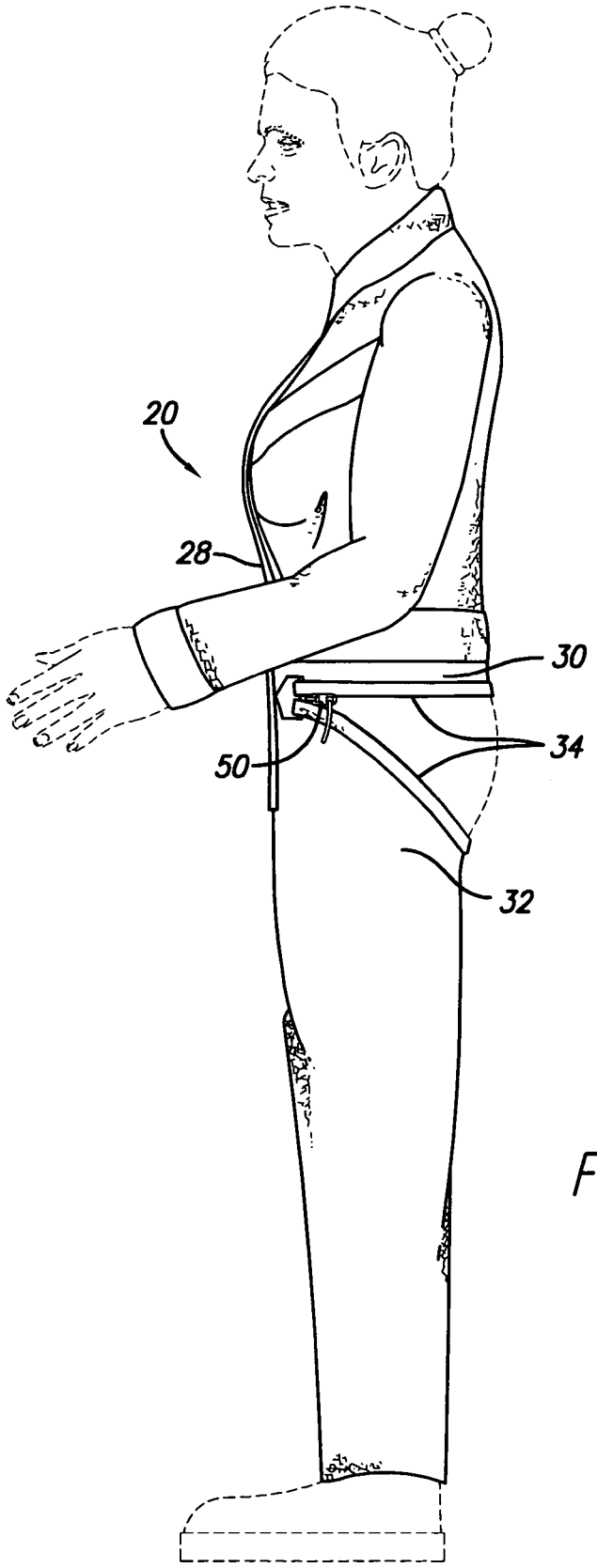
FIG. 7 is a side elevation view of the fastener means in a fully open position.

FIG. 7 is a side elevation view of fastener means 34 in a fully open position.

Figure 8:
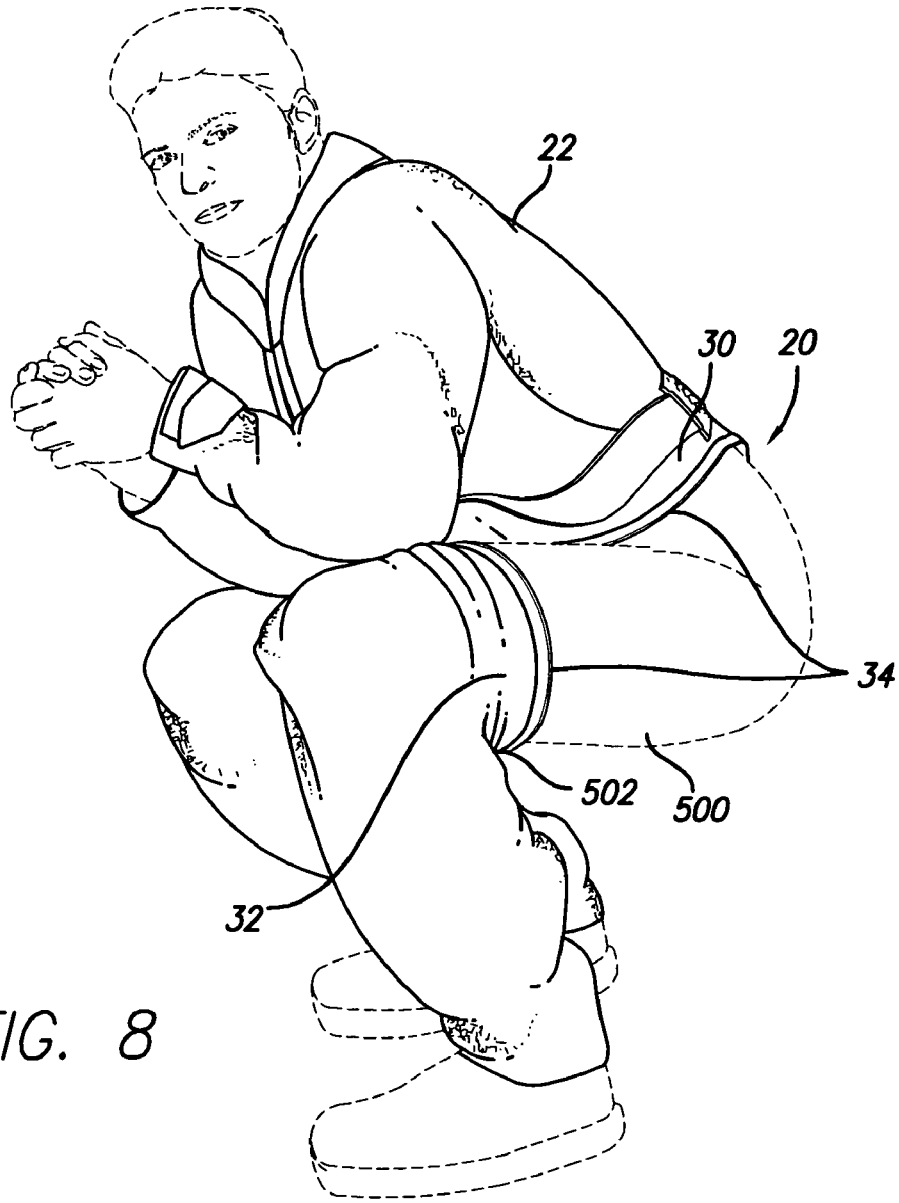
FIG. 8 is a side perspective view of the jumpsuit with the wearer in a squatting position.

FIG. 8 is a side perspective view of jumpsuit 20 with the wearer in a squatting position as for urination. When fastener means 34 is fully open, lower portion 32 splits away from upper portion 30 so the woman may assume a squatting position wherein lower portion 32 may be pulled all the way down the woman's thighs 500 thereby vacating lower portion 32 from an area below the woman's crotch (also refer to FIG. 10). In an embodiment of the invention, lower portion 32 is pulled down the woman's thighs 500 all the way to the hollow of the woman's knees 502.

Figure 9:
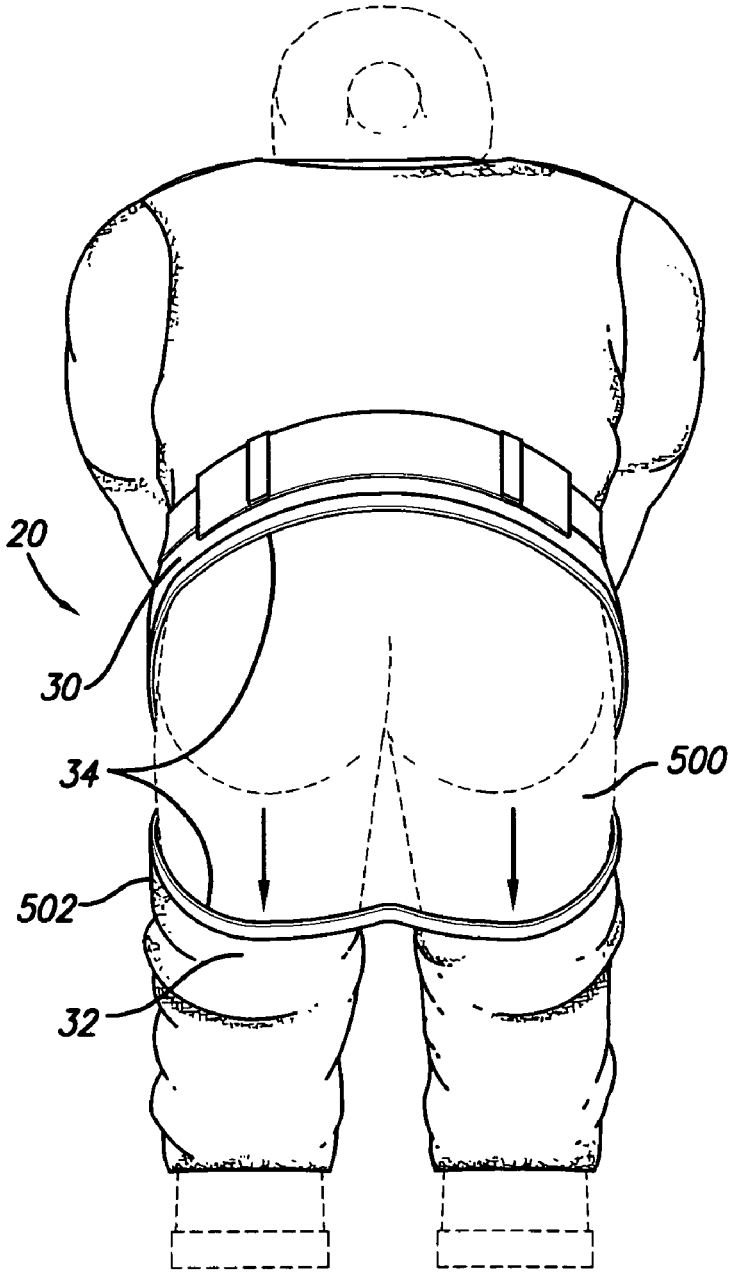
FIG. 9 is rear elevation view of the jumpsuit with the wearer in a squatting position; and, FIG. 10 is a bottom plan view of the jumpsuit with the wearer in a squatting position.

FIG. 9 is rear elevation view of jumpsuit 20 with the wearer in a squatting position. Because of fastener means 34, lower portion 32 may be split away from upper portion 30 and pulled down the woman's thighs 500 to the hollow of the knees 502.

Figure 10:
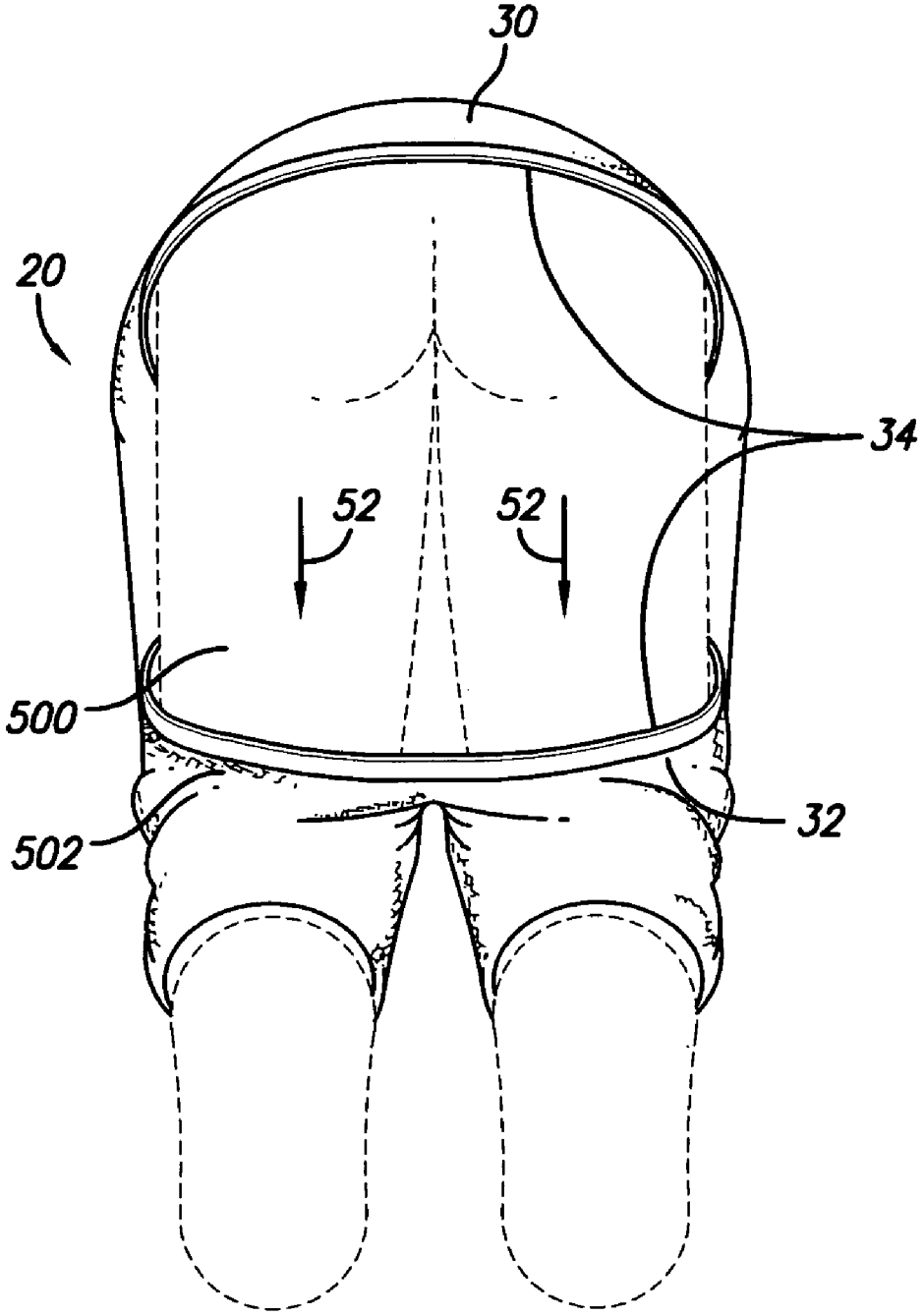

FIG. 10 is a bottom plan view of the jumpsuit with the wearer in a squatting position. It is noted that lower portion 32 has been pulled down the woman's thighs 500 in direction 52 to the hollow of the knees 502, thereby removing all jumpsuit material from below the woman's crotch. In this manner, urination can be effected without wetting jumpsuit 20. In terms of use, a method for a woman to urinate when dressed in a jumpsuit includes:

(a) providing a jumpsuit 20 for the woman, the jumpsuit 20 including;
  - a body 22 having a central axis 24, a waist 26, a front side 28, an upper portion 30, and a lower portion 32;
  - fastener means 34 for selectively connecting upper portion 30 to lower portion 32, fastener means 34 having a first end 36 and an opposite second end 38, wherein when fastener means 30 is fully closed upper portion 30 is connected to lower portion 32, and when fastener means 34 is fully open upper portion 30 is partially connected to lower portion 32 by a connector strip 40 disposed between first end 36 and second end 38 of fastener means 34;
  - connector strip 40 substantially centrally disposed on said front side 28; and,
  - fastener means 34 circumscribing an arc of at least 270° around central axis 24;

(b) fully opening fastener means 34;

(c) assuming a squatting position;

(d) pulling said lower portion 32 down the woman's thighs 500 away from the crotch and toward the hollow of the woman's knees 502 so that lower portion 32 vacates an area below the woman's crotch; and, (e) urinating.

The method further including:

in step (d), pulling said lower portion 32 down the woman's thighs 500 all the way to the hollow of the woman's knees 502.

The method further including:

in step (a), the arc being about 340°.

The method further including:

in step (a), the arc disposed substantially perpendicular to central axis 24.

The method further including:

in step (a), first end 36 and second end 38 of fastener means 34 disposed below waist 26.

The method further including:

a second fastener means 44 having an upper end 46 and a lower end 48, second fastener means 44 disposed on front side 28 and oriented parallel to central axis 24, second fastener means 44 substantially bisecting connector strip 40;

second fastener means 44 running from below fastener means 34 to above waist 26;

second fastener means 44 opening from lower end 48; and, before step (d), opening second fastener means 44 from lower end 48 to at least waist 26.

Opening second fastener means 44 can enhance the use of jumpsuit 20 during urination by allowing first end 36 to separate from second end 38 of fastener means 34 at connector strip 40, thereby effectively increasing the perimeter of lower portion 32.

The preferred embodiments of the invention described herein are exemplary and numerous modifications, variations, and rearrangements can be readily envisioned to achieve an equivalent result, all of which are intended to be embraced within the scope of the appended claims.

I claim:

1. A method for a woman to urinate when wearing a jumpsuit, comprising:

(a) providing a jumpsuit for the woman, said jumpsuit including:

a body having a central axis, a waist, a front side, an upper portion, and a lower portion;

fastener means having a first end and an opposite second end for selectively connecting said upper portion to said lower portion, wherein when said fastener means is fully closed said upper portion is connected to said lower portion, and when said fastener means is fully open said upper portion is partially connected to said lower portion by a connector strip disposed between said first end and said second end;

said connector strip substantially horizontally centrally disposed on said front side; and, said fastener means circumscribing an arc of at least 270° around said central axis;

a second fastener means having an upper end and a lower end, said second fastener means disposed on said front side and oriented parallel to said central axis, said second fastener means substantially bisecting said connector strip;

said second fastener means running from below said fastener means to above said waist; and, said second fastener means opening from said lower end;

(b) fully opening said fastener means;

(c) assuming a squatting position;

(d) before step (e), opening said second fastener means from said lower end to at least said waists;

(e) pulling said lower portion down the woman's thighs so that said lower portion vacates an area below the woman's crotch; and, (e) urinating.

2. A jumpsuit, comprising:

a body having a central axis, a waist, a front side, an upper portion, and a lower portion;

fastener means having a first end and an opposite second end for selectively connecting said upper portion to said lower portion, wherein when said fastener means is fully closed said upper portion is connected to said lower portion, and when said fastener means is fully open said upper portion is partially connected to said lower portion by a connector strip disposed between said first end and said second end;

said connector strip substantially horizontally centrally disposed on said front side;

said fastener means circumscribing an arc of at least 270° around said central axis;

a second fastener means having an upper end and a lower end, said second fastener means disposed on said front side and oriented parallel to said central axis, said second fastener means substantially bisecting said connector strip;

said second fastener means running from below said fastener means to above said waist; and, said second fastener means opening from said lower end.

* * * * *